US005580063A

United States Patent [19]

Edwards

[11] Patent Number: 5,580,063

[45] Date of Patent: Dec. 3, 1996

[54] REUSABLE PROJECTILE IMPACT REFLECTING TARGET FOR DAY OR NIGHT USE

[75] Inventor: A. W. Edwards, Bonita Springs, Fla.

[73] Assignee: Birchwood Laboratories Inc., Eden Prairie, Minn.

[21] Appl. No.: 587,676

[22] Filed: Jan. 17, 1996

[51] Int. Cl.[6] ..... F41J 5/00

[52] U.S. Cl. ..... 273/378; 273/408

[58] Field of Search ..... 273/378, 408, 273/409

[56] References Cited

U.S. PATENT DOCUMENTS 3,895,803 7/1975 Loe ..... 273/378

5,188,371 2/1993 Edwards ..... 273/378

5,501,467 3/1996 Kandel ..... 273/378

*Primary Examiner*—William H. Grieb

*Attorney, Agent, or Firm*—Vidas, Arrett & Steinkraus

[57] ABSTRACT

A reusable projectile impact reflecting target for day and night use, and more particularly to a target with a replaceable primary target label including a polypropylene film containing a colored ink target image from which the ink is removed at the point of projectile impact exposing a contrasting colored photoreflective ultraviolet pigmented ink on the surface to increase visibility. A release agent causes the removable ink to be removed in a controlled manner to form a desired halo effect.

1 Claim, 4 Drawing Sheets

REUSABLE PROJECTILE IMPACT REFLECTING TARGET FOR DAY OR NIGHT USE

CROSS-REFERENCE TO RELATED PATENTS

U.S. Pat. No. 5,188,371 issued Feb. 23, 1993 of the same title reflects applicant's earlier invention. The present invention reflects improvements to that invention.

BACKGROUND OF THE INVENTION

1. Field of the Invention

This invention generally relates to a reusable projectile impact reflecting target for day and night use, and more particularly to a target with a replaceable primary target label including a polypropylene film containing a colored ink target image from which the ink is removed at the point of projectile impact exposing a contrasting colored photoreflective ultraviolet pigmented ink on the under surface to increase visibility.

2. Description of the Related Art

Ballistic targets for firearms are well known in the prior art. Among the many problems therewith include that the projectile holes in the target are difficult to see, and that repeated projectile penetrations of the primary target area at the bulls eye, limit the service life of the target. Hence many ballistic targets have been developed with improved means to visually see a bright marking at the projectile point of entry, but have proved to be cumbersome and expensive to produce, and they have not addressed the problems of limited target service life, and night usage.

U.S. Pat. No. 3,895,803 discloses a colored backing sheet covered with a transparent plastic sheet having a target pattern thereon whereby the plastic sheet is permanently bonded to the backing sheet and the entire target has to be replaced after a number of bullet hole penetrations.

None of the prior art provides a ballistic target for firearms as herein provided, which provides a primary target label which can be replaced after a number of projectile penetrations, utilizing the original base material, and at the same time provides a projectile penetrated surface which is easily visible both day and night.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

SUMMARY OF THE INVENTION

It is a object of the present invention to provide a ballistic target for firearms having a replaceable primary target surface which can be replaced while the support backing is still in good condition.

It is a further object of the invention to provide a replaceable target for firearms which provides a projectile penetration reflective target surface which is easily visible.

It is another object of the invention to provide a target which will indicate projectile impact under normal lighting, as well as low light level conditions.

It is another further object of the invention to reduce the amount of environmentally wasteful material by virtue of its reusable feature.

It is also an objective of the invention that the method of manufacturing is highly cost effective and efficient, resulting in a substantial lowering of unit cost compared with prior art.

The reusable projectile impact reflecting target of the present invention includes a target base and a primary target label. The target base contains a material substantially forming an overall target shape. The primary target label includes a bottom paper layer having a colored photoreflective ink on its forward surface, and a pressure sensitive adhesive on its rear surface so that the target label can be releasably attached to the target base. The target label also includes a polypropylene film layer having a target image imprinted with ink on its front surface but not securely bonded thereto. The imprinted ink contrasts in color with the photoreflective ink on the bottom paper layer. A pressure sensitive adhesive on the back surface of the polypropylene film permits it to be attached to the bottom paper layer. When the polypropylene film is attached thereto, the photoreflective ink on the paper layer is totally concealed by the contrasting colored ink on the polypropylene film except for concentric rings and ring numbers on the target image resulting from reverse printing of the target image. The concentric rings and ring numbers assist in seeing the target image by exposing the photoreflective ink on the paper layer. The penetration of a projectile through the primary target label causes the contrasting colored ink on the polypropylene film to be removed, thereby exposing a clear area larger than the penetration point of the projectile thereon, causing the colored photoreflective ink surface on the bottom paper layer to show through the transparent projectile impact zone on the polypropylene film.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 1:
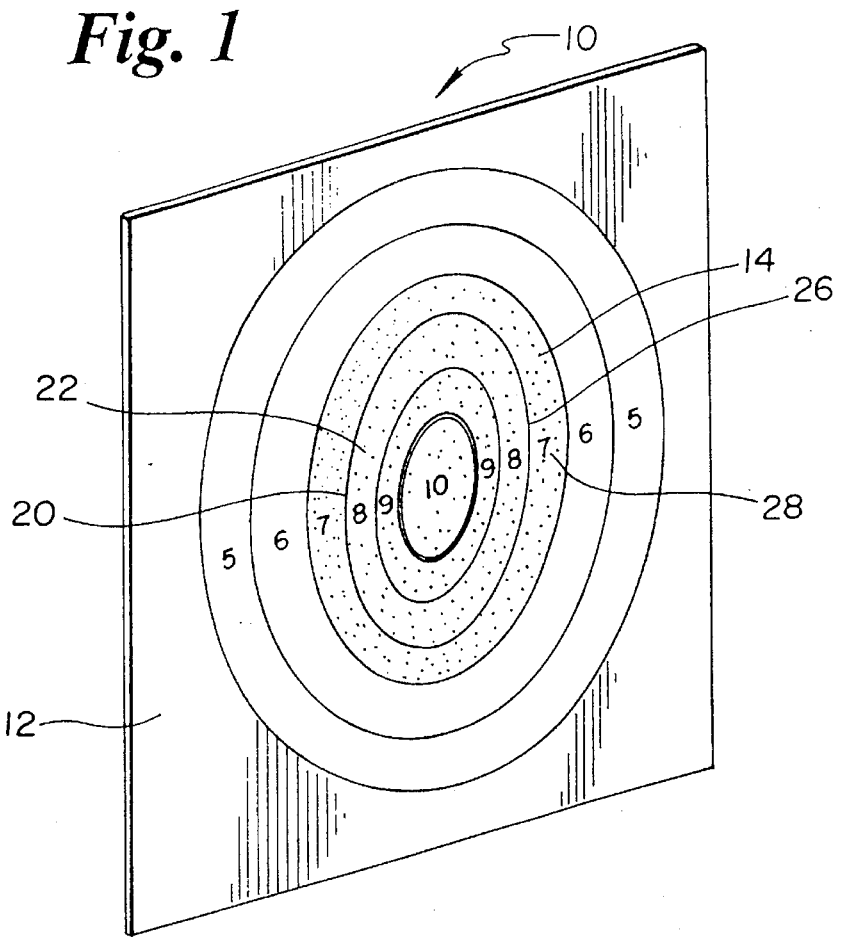
FIG. 1 is a perspective view of a preferred embodiment of the target of the invention showing the components of the target.

Referring to the drawings, and in particular FIG. 1, thereof, a preferred structure of the reusable projectile impact reflective target 10 of this invention is shown including the various components. The target base 12 is shown supporting the primary target label 14 which includes a bottom paper layer 16 and a top plastic film layer 18 shown in FIG. 7.

Figure 3:
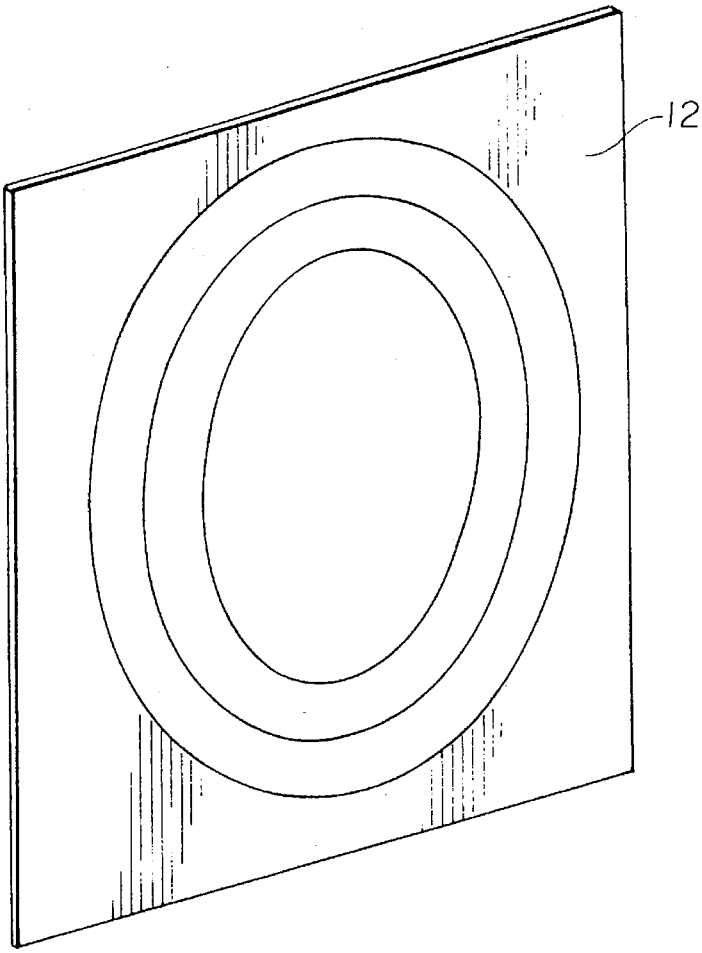
FIG. 3 is a view of the target base.

The principle element of target base 12 as seen in FIG. 3 is a square sheet of heavy weight paper, approximately 40–60 pound weight, having printed target alignment marks located on its outer surface.

Figure 4:
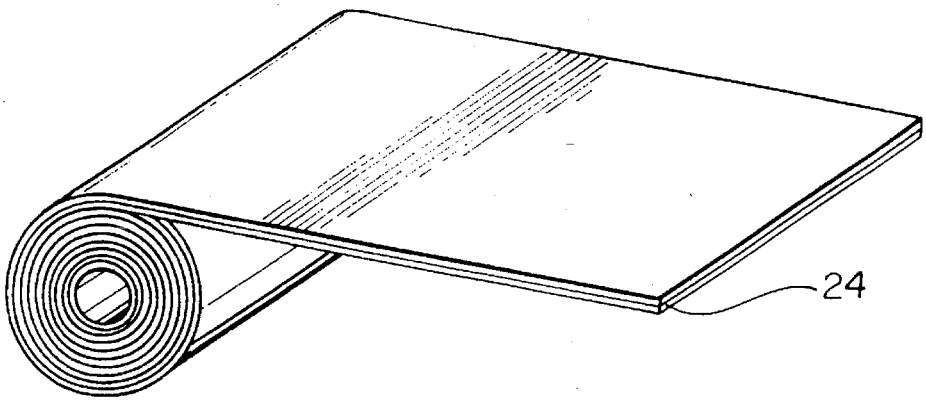
FIG. 4 is a view of the bottom layer of paper releasably mounted on its backing.

The bottom paper layer 16 of the primary target label 14 is a light weight sheet of paper of pressure sensitive stock which is releasably attached to a backing paper as seen in FIG. 4 which permits primary target label 14 to be releasably attached to target base 12. The lightweight pressure sensitive stock of paper layer 16 is a standard industrial item which is obtained as a pressure sensitive stock material releasably attached to a backing paper. A flat tint of light color photoreflective ink 20, such as fluorescent yellow which contains an ultraviolet responsive pigment, is printed on its surface. This is supplied for optimum production efficiency in a roll stock material.

Figure 5:
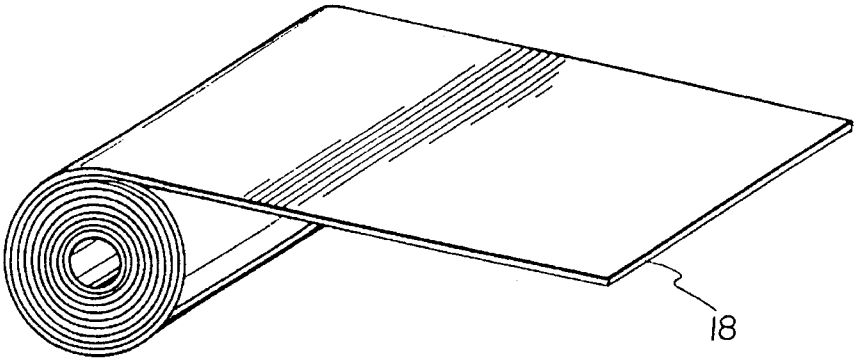
FIG. 5 is a view of the polypropylene film on its roll.

The layer of plastic film preferably includes a strip of polypropylene film 18 preferably a transparent biaxially oriented polypropylene film having a pressure sensitive rubber or acrylic base adhesive backing. This is also standard commercial item in roll form shown in FIG. 5 for optimum production efficiency. A strip of polypropylene film 18 is removed from the roll and is adhered to the photoreflective inked surface of the paper layer 16. Other plastic films such as polyethylene, polyacrylic, mylar and similar films maybe substituted for polypropylene.

A coating of a contrasting colored flat ink 22 which provides a sufficient degree of contrast between the primary target substrate photoreflective ink 20, to allow easy visual sighting of a projectile impact of penetration of the primary target objective, is then applied to the front surface of the polypropylene film 18. The colored flat ink 22 is applied by reverse printing in the form of a target image such as a bull's eye or similar target design. It has been found that two coats of ink 22 may be required, a first layer of a black gloss ink followed by a second layer of black flat ink.

Printing on top of the polypropylene film is a radical and novel departure from conventional film production. Prior art film laminate imprinting procedures generally require a top coat or print coat to the surface of the polypropylene film prior to printing thereon, to ensure that the printing on the film is adherent. The previous patent, U.S. Pat. No. 5,188,371, did exactly the reverse by deliberately omitting such a top or print coat on the film and printing thereon by reverse printing technique. The result was that the reverse print adheres well under ordinary conditions but is removed at the point of impact of a projectile.

The present improvements concern the addition of a release agent 70 between the print 22 and the plastic 18. The application of a release agent is contrary to normal printing convention as it inhibits the adhesion of ink to the surface of the substrate to which it is applied. Surprisingly, the addition of a release agent does not cause the print to completely fall off when hit by a projectile. Rather, the print is able to break loose to a greater, but very controlled extent such that a clear region of highlight color is seen from a distance. The release agent 70 still allows enough adhesion of the print 22 to keep the print in place except around the point of impact. The impact point results in a controlled release of print 22 from the release agent 70 instead of cracking of the print. Such a result is totally unexpected in the present invention.

Rather than adding an ink receptive print adhesion agent, referred to as a print or top coat in the printing industry, which is conventionally used to attach the print 22 to the plastic 18, a release agent 70 is used to provide a better "halo effect" around the impact hole to make it uniform and of the correct size, while at the same time providing superior ink displacement properties. The release agent 70 is preferably a silicone release agent with an increase in silicone content producing a larger halo effect around the point of impact. A decrease in silicone in the release agent 70 will cause the "halo effect" to be smaller, inconsistent or non-existent depending on the amount of decrease. This feature provides an infinite adjustment of the degree of ink displacement possible, a highly desirable attribute as it allows a large halo effect for small caliber projectile impact holes, which are normally difficult to see. Suitable release agents include those of Northwest Coatings Corp.. of Oak Crest, Wis. under their designation 9074A and 8684A containing mixed acrylates, insoluble in water, boiling point greater than 200° C.

Conversely, a reduced halo effect for large caliber projectile impact holes may be achieved since they are easier to observe due to their size. In addition, larger projectile impact holes reduce the service life of the target resulting from a larger halo effect which reduces the remaining usable surface area. The ability to regulate the amount of ink displacement for a wide range of calibers is a feature which ensures optimum results when the percentage of release agent 70 is calibrated for the impact of specific calibers. The distance from the shooter to the target may also be a reason to vary the halo effect. Longer distance shooters may benefit from a larger halo effect.

The target image printed on the surface of the polypropylene film layer 18 is reverse or a negative print. This means essentially that the non image areas are printed, and the actual image areas left unprinted, which creates a negative, or reverse image. By using the reverse image printing method on the polypropylene film layer 18, the design of the target's image bull's eye concentric rings 26 and the ring numbers 28 are highly visible because the photoreflective ink 20 is exposed through the unprinted portions of rings 26 and numbers 28 on the polypropylene film layer 18 as a result of the reverse printing procedure. Thus the additional advantage of this feature is that the photoreflective ink concentric rings 26 and ring numbers 28 which are integral parts of the bull's eye target design become primary sighting alignment aids by affording the user a high profile aiming pattern when using the target particularly in low light levels as a result of the ultraviolet reflectivity of the photoreflective ink 20. Applicant is not aware of any prior art directed to these improvements in targets. Prior art targets appear to rely on conventional reverse printing methods which do not produce this type of surface to assist the marksman in seeing the target especially under low light level conditions.

Figure 6:
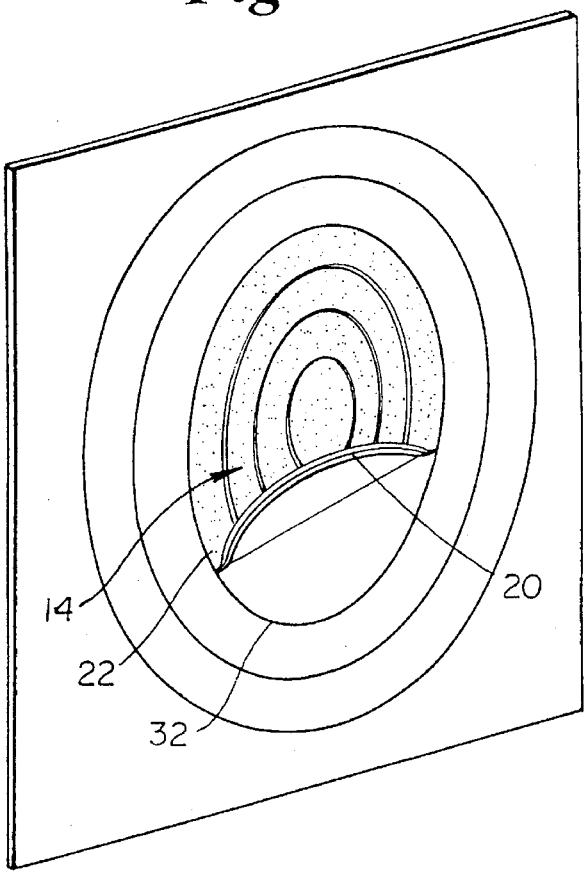
FIG. 6 is a view of the primary target label being removed from the target base.
Figure 7:
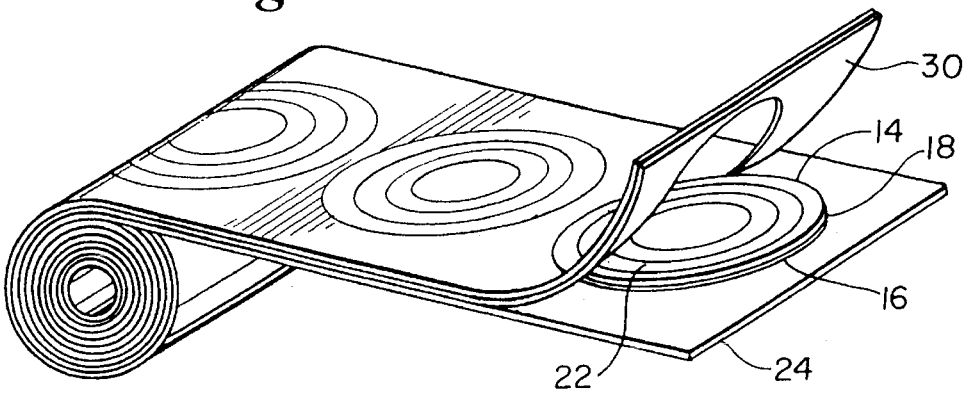
FIG. 7 is a view of the overlaminated die cut primary target being prepared.
Figure 8:
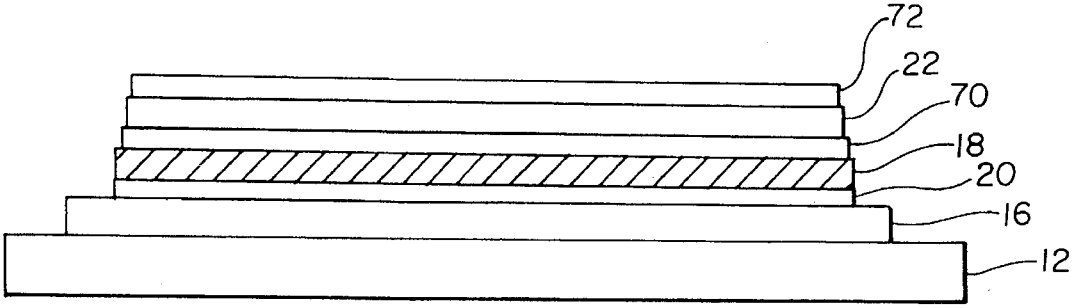
FIG. 8 is a cross-sectional view of the improved target showing the addition of layers.

Following the adherence of the polypropylene film layer 18, application of release agent 70 and the reverse printing thereon of the bull's eye or similar target design, a target shape is then die cut through the lamination material as seen in FIG. 7 to form the primary target label 14. The waste material 30, which is the lamination and label stock material surrounding the die cut shapes, is then removed from the backing paper 24. The target label 14 adhering to backing paper 24 now is ready to be applied to the target base 12. In doing so, the primary target label 14 is first removed from the backing paper 24 and is positioned on the predetermined alignment marks 32, usually the open central target area, located on the target base 12 as shown in FIG. 6.

It has also been found that the addition of a protective layer 72 over the black ink 22 is desirable for the following reasons. The protective layer 72 considerably reduces the possibility of surface abrasions caused during production and normal handling. The protective layer helps prevent non-impact caused damage that would peel away the ink 22 to expose the underlying contrasting ink 20. In addition, the application of protective layer 72 had the unexpected result of rendering the contrasting ink 22 highly resistant to water. This is beneficial since outdoor shooting ranges subject targets to humidity and rain. This ability of the target to repel water is highly desirable. A standard water based overprint varnish is beneficial for these purposes.

Figure 2:
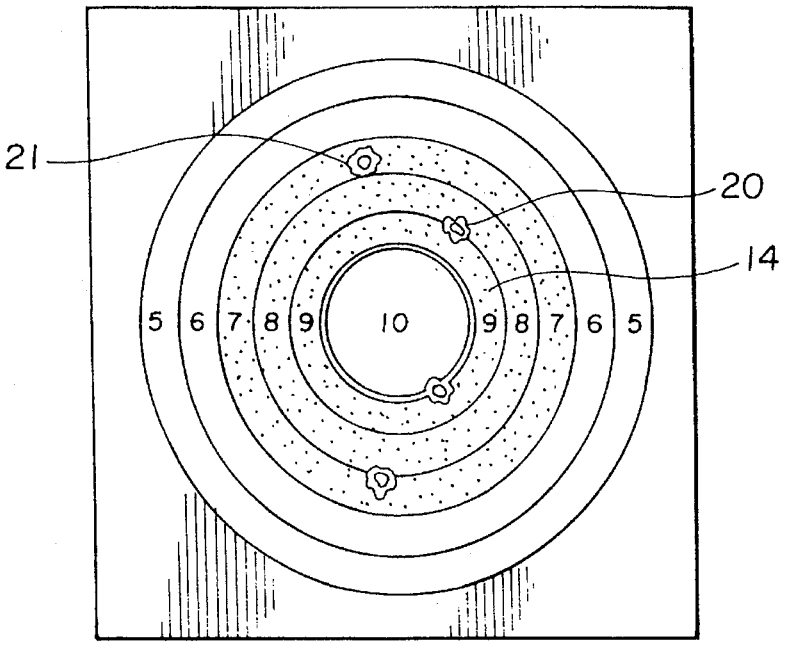
FIG. 2 is a view of a projectile penetration of the target according to the invention.

In operation of the invention, as seen in FIG. 2, when a projectile strikes the polypropylene film layer 18 of the primary target label 14, the shockwave of impact and penetration 21 cause the contrasting colored ink 22 in the immediate peripheral area of the projectile impact zone to be displaced, leaving an area larger than the profile penetration point from which the contrasting colored ink 22 has been removed. As the clear polypropylene film is uncovered in this area, the background of the photoreflective ink 20 is revealed and clearly visible. If the ultraviolet light pigment in the photoreflective ink of the primary target substrate is exposed during normal daylight conditions, a normal visual sighting occurs. During darkness or low light levels, ultraviolet rays generated by a typical commercial ultraviolet light source as manufactured by numerous electric supply companies under generic part numbers, as for example light fixture F40T12/BLB, would be directed and aligned towards the primary target label mounted on the target base. The ultraviolet pigment revealed by projectile impact or penetration of the primary target label would be activated by the ultraviolet rays, thereby allowing a visual sighting of any direct hits. This target enhancement would be of particular interest to law enforcement and military agencies who must develop marksmanship and accuracy skills in low light level conditions.

After the primary target label 14 has been penetrated by numerous projectiles which would render the primary target label 14 incapable of identifying additional projectile impact points, the expended primary target label 14 may be either removed from the target base 12 backing sheet and replaced by a new primary target label 14, or alternatively, a replacement primary target label 14 may be affixed directly on top of the expanded primary target label 14. Replacement of the primary target label 14 will allow reuse of the target base 12 backing as long as it remains serviceable, at least a minimum of two or three rotations, substantially reducing the amount of waste generated, and total unit cost.

It will be further understood by those skilled in the target art that various modifications may be made in the target of this invention without departing from the spirit and scope of the invention.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A reusable projectile impact reflecting target for day or night use comprising in combination:

a target base and a primary target label, said target base comprising sheet of backing material substantially forming an overall shape, said target base having an outer surface with a target outline imprinted thereon, said primary target label comprising a bottom paper layer and a top plastic film layer, said bottom paper layer comprising a sheet of paper having a forward and a rear surface, said rear surface adapted to be releasably mounted within said target outline, said forward surface having a colored photoreflective ink thereon, said plastic film layer comprising a transparent strip of plastic having a front and back surface, said back surface, adapted to be mounted on said forward surface of said paper layer, said front surface defining a target image of contrasting colored image contrasting in color to the color of said photoreflective ink, said contrasting ink being adhered to said front surface by a silicone release agent but not being permanently bonded thereto, whereby when said primary target label is releasably mounted on said target base, the penetration of a projectile causes said contrasting colored ink to be removed from the plastic film layer front surface point of penetration exposing a clear area larger than the penetration point of the projectile, thereby exposing the photoreflective ink paper layer.

* * * * *